US011015761B1

(12) United States Patent
Villarreal et al.

(10) Patent No.: US 11,015,761 B1
(45) Date of Patent: May 25, 2021

(54) COMPOSITE PRESSURE VESSEL FOR GAS STORAGE AND METHOD FOR ITS PRODUCTION

(71) Applicant: CleanNG, LLC, Tulsa, OK (US)

(72) Inventors: Robert Matthew Villarreal, Tulsa, OK (US); Efren Luevano, Tulsa, OK (US); Michael Tate, Tulsa, OK (US); Aaron Earl Laney, Tulsa, OK (US)

(73) Assignee: CleanNG, LLC, Tulsa, OK (US)

( * ) Notice: Subject to any disclaimer, the term of this patent is extended or adjusted under 35 U.S.C. 154(b) by 0 days.

(21) Appl. No.: 14/550,594

(22) Filed: Nov. 21, 2014

Related U.S. Application Data

(60) Provisional application No. 61/907,809, filed on Nov. 22, 2013.

(51) Int. Cl.
*F17C 1/06* (2006.01)
*F17C 1/16* (2006.01)

(52) U.S. Cl.
CPC ..... *F17C 1/16* (2013.01); *F17C 2203/0634* (2013.01)

(58) Field of Classification Search
CPC ..... F17C 1/16; F17C 2203/0634; F17C 2209/2163; F17C 1/005; F17C 1/00; F17C 13/002; F17C 2209/2154
USPC ..... 220/586, 581, 582, 588, 589; 428/36.7
See application file for complete search history.

(56) References Cited

U.S. PATENT DOCUMENTS 2,127,712 A * 8/1938 Blaslus ..... F17C 1/04 220/586
2,363,967 A * 11/1944 McLean ..... F17C 1/06 138/140
2,629,354 A * 2/1953 Gay ..... B21D 51/24 220/586
2,933,214 A * 4/1960 Douyard ..... F16L 41/084 220/588
3,047,191 A * 7/1962 Young ..... B29D 22/003 138/DIG. 2
3,508,677 A * 4/1970 Laibson ..... B29C 65/00 220/590
3,598,275 A * 8/1971 Francois ..... B65D 90/02 114/341
3,866,792 A * 2/1975 Minke ..... B29C 53/605 156/175
4,004,706 A * 1/1977 Guldenfels ..... B65D 90/02 220/586

(Continued)

*Primary Examiner* — Robert Poon
(74) *Attorney, Agent, or Firm* — GableGotwals

(57) ABSTRACT

A pressure vessel includes a carbon fiber reinforced plastic with an integrated permeation barrier as its innermost layer. Alternating layers of permeation barrier and carbon fiber reinforced plastic may also be used. During manufacturing, the permeation barrier is sprayed on and integrated into the composite. The vessel, which is well-suited for high pressure gas storage is lighter weight than prior art vessels and has more usable volume than same-dimensioned prior art vessel. The permeation barrier encapsulates one or more ports or fittings of the vessel to reduce or eliminate the potential for gaps through which gas can escape. In one embodiment, a removable tooling process is employed in the manufacture of the vessel. In another embodiment, a permanent tooling process is employed and the tooling serves as a sorbent material for the vessel.

10 Claims, 4 Drawing Sheets

(56) References Cited

U.S. PATENT DOCUMENTS 4,053,081 A * 10/1977 Minke ..... B01J 3/048 156/175
RE30,489 E * 1/1981 Abbott ..... B29C 53/60 138/109
4,244,482 A * 1/1981 Baumgart ..... F16J 12/00 138/142
4,252,244 A * 2/1981 Christian ..... B21D 51/24 220/586
4,296,869 A * 10/1981 Jawad ..... B65D 88/04 220/586
4,398,646 A * 8/1983 Pechacek ..... F17C 1/04 220/586
4,671,831 A 6/1987 Mohan
4,699,288 A * 10/1987 Mohan ..... B29C 53/602 220/560.01
4,925,044 A * 5/1990 Hembert ..... F17C 1/12 220/589
5,004,120 A * 4/1991 Hembert ..... F17C 1/16 220/560.01
5,012,950 A * 5/1991 Knappe ..... B29C 70/086 126/373.1
5,025,943 A * 6/1991 Forsman ..... B29C 53/602 220/589
5,419,139 A * 5/1995 Blum ..... B32B 7/02 62/45.1
5,476,189 A * 12/1995 Duvall ..... F17C 1/16 220/588
5,518,140 A * 5/1996 Lenz ..... F17C 9/00 220/528
5,534,318 A * 7/1996 Andre De La Porte ..... B29C 70/00 220/562
5,653,358 A * 8/1997 Sneddon ..... F17C 1/16 220/590
5,758,796 A * 6/1998 Nishimura ..... F17C 1/06 220/590
5,772,938 A * 6/1998 Sharp ..... B29C 53/8075 220/589
5,822,838 A * 10/1998 Seal ..... B21D 51/24 156/172
5,875,648 A * 3/1999 Boye ..... F25B 35/04 62/480
6,015,065 A * 1/2000 McAlister ..... F17C 1/02 220/501
6,022,435 A * 2/2000 Palazzo ..... B29C 47/0019 156/187
6,138,861 A * 10/2000 Palazzo ..... B65D 90/505 156/187
6,145,692 A * 11/2000 Cherevatsky ..... F17C 1/04 220/581
6,145,693 A * 11/2000 Berglund ..... B29C 53/602 220/565
6,230,922 B1 * 5/2001 Rasche ..... F17C 1/16 220/586
6,547,092 B1 * 4/2003 Chervatsky ..... F17C 1/00 220/581
6,708,502 B1 * 3/2004 Aceves ..... F17C 3/08 220/560.08
6,989,198 B2 * 1/2006 Masuda ..... B32B 1/08 138/141
7,255,904 B2 * 8/2007 Tai ..... B32B 27/08 428/220
7,641,949 B2 * 1/2010 DeLay ..... B29C 53/602 220/586
7,867,589 B2 1/2011 DeLay
8,074,826 B2 * 12/2011 Cronin ..... B29C 53/602 156/173
8,297,468 B1 * 10/2012 DeLay ..... F17C 1/06 220/560.12
8,308,017 B2 * 11/2012 Schlag ..... F16J 12/00 220/586
8,377,529 B2 * 2/2013 Bekele ..... B32B 7/12 428/35.2
8,481,136 B2 * 7/2013 Sneddon ..... B29C 70/86 156/169
8,561,829 B1 * 10/2013 DeLay ..... F17C 1/16 220/588
8,740,009 B2 * 6/2014 Otsuka ..... F17C 13/06 220/588
8,815,360 B2 * 8/2014 Beckwith ..... A23L 3/3436 426/127
8,932,695 B1 * 1/2015 Villarreal ..... F17C 1/06 220/560.14
2003/0111473 A1 * 6/2003 Carter ..... F17C 1/06 220/586
2003/0175457 A1 * 9/2003 Jousse ..... B32B 27/08 428/36.7
2005/0087536 A1 * 4/2005 Caudill ..... F17C 1/14 220/586
2006/0054628 A1 * 3/2006 Matsuoka ..... F17C 1/06 220/581
2006/0096993 A1 * 5/2006 Takashima ..... F17C 1/06 220/588
2006/0163261 A1 * 7/2006 Sugiura ..... F17C 1/06 220/581
2008/0121643 A1 * 5/2008 Blencoe ..... C01B 3/065 220/589
2009/0057319 A1 * 3/2009 Schlag ..... B29C 41/04 220/586
2009/0308874 A1 * 12/2009 Lindner ..... B29C 70/32 220/560.05
2010/0276434 A1 * 11/2010 Berger ..... F17C 1/06 220/586
2011/0240655 A1 * 10/2011 Lindner ..... F16J 12/00 220/589
2012/0048865 A1 * 3/2012 Eihusen ..... F17C 13/002 220/586
2013/0306651 A1 * 11/2013 Markert ..... F17C 1/16 220/582
2014/0166664 A1 6/2014 Lin et al.
2015/0240993 A1 * 8/2015 DeLay ..... F17C 1/06 220/590
2015/0316207 A1 * 11/2015 Laney ..... B05D 1/02 220/581

* cited by examiner

COMPOSITE PRESSURE VESSEL FOR GAS STORAGE AND METHOD FOR ITS PRODUCTION

CROSS-REFERENCE TO PENDING APPLICATIONS

This application claims the benefit of U.S. Prov. Pat. Appl. No. 61/907,809 for a Composite Pressure Vessel for Gas Storage and a Method for Its Production, filed Nov. 22, 2013.

BACKGROUND OF THE INVENTION

This invention relates generally to the field of composite materials and, more particularly, to gas-impermeable composite materials which include carbon fibers and are intended for use in high pressure applications.

Pressure vessels are used in many industries to store gasses under high pressures. These pressure vessels are generally constructed out of carbon-based composites, namely, a high strength plastic reinforced with carbon fiber filaments. A separate plastic or aluminum, thick-walled, rigid liner is used as the form on which the carbon fiber filaments are wound during the manufacturing process.

The metal and plastic liners are costly to manufacture and must go through a variety of resource-intensive processes. The manufacturing process involves a filament winding process in which a fiber tow is first impregnated with a matrix resin and then applied at predetermined angles to a rotating liner or mandrel (which is typically made of aluminum or high-density polyethylene). After the impregnated fibers are applied, the structure must be cured, usually by heat.

The plastic or aluminum liner is permanently trapped within the vessel to achieve a permeation barrier. This adds unnecessary weight to the vessel and reduces its usable volume. Additionally, the liner can become detached from the composite shell, thereby eroding its structural integrity and causing leaks. Furthermore, these metal and polymeric liners experience cyclical fatigue which decreases the useful life of the vessel.

By way of example, a composite pressure vessel used for high pressure cryogenic storage is disclosed in U.S. Pat. No. 7,867,589 to DeLay, the subject matter of which is hereby incorporated by reference. The inner layer of the vessel is a matrix of fiber (e.g., aramid fiber) and polyurethane resin. The outer layer encapsulates the inner layer, provides structural support to that layer, and is a matrix of fiber (e.g., aramid or carbon fiber) and resin (e.g., high ductability resin or polyurethane matrix that performs well at low temperature). Once the inner and outer layers are cured, the mandrel is removed. Because this vessel is designed to contain a liquid stored at low temperatures, it does not require an impermeable barrier. Therefore, the vessel can make use of carbon (or aramid) fibers and forego a metal or polymeric liner.

Adsorbed natural gas provides a method of storing a lot more natural gas per volume of storage than can be achieved with simple compression. Using this method, the vessel includes a sorbent. The sorbent, which is typically an active carbon with a high surface area, adsorbs the natural gas and allows the vessel to store well over 100 times the volume of gas than it could otherwise store, and do so at pressures less than ⅕ of those otherwise and at ambient temperatures.

Prior art ANG pressure vessels are metal pressure vessels with an adsorbent core (see e.g. US Pat. App. Pub. No. 2014/0166664 A1 to Lin et al.). The vessels are relatively heavy—thereby reducing fuel efficiency when used in motor vehicle applications—and can corrode and experience cyclical fatigue, thereby leading to failure.

There is a need for a high pressure, liner-free vessel for storing compressed natural gas that is more easily manufactured than prior art carbon- and aramid-fiber based vessels, does not involve a metallic or polymeric liner, and is lighter weight and smaller than metal pressure vessels of equivalent size and pressure ratings.

SUMMARY OF THE INVENTION

A pressure vessel made according to this invention includes a carbon fiber reinforced plastic with an integrated permeation barrier as its innermost layers. The barrier can be metal-free impermeable film or metallic additives could be used in the film. In one embodiment of the vessel, a removable tooling process is employed in the manufacture of the vessel. In another embodiment of the invention, the tooling remains as an integral part of the vessel and serves as a sorbent. During the manufacturing of both embodiments, the permeation barrier is sprayed on and integrated into the composite.

The vessel, which is well-suited for high pressure gas storage (100-10,000 psig), is lighter weight than prior art vessels and has more usable volume (in a range of about 8-10%) than a same-dimensioned prior art vessel. The permeation barrier encapsulates one or more ports or fittings of the vessel to reduce or eliminate the potential for gaps through which gas can escape.

Objectives of this invention are to provide a pressure vessel or tank which (1) is plastic liner- and aluminum liner-free; (2) avoids the use of a separate, rigid liner and incorporates impermeability layers or strata into the composite structure; (3) provides a reinforced plastic having superior strength, durability and gas barrier properties when compared to that used in current art pressure vessels; (4) can be used for pressure vessels in gas storage applications in a range of about 100 psi and up; (5) can provide a liner-less or liner-free pressure vessel (e.g. a type III or IV tank) for use in non-cryogenic storage applications above 100 psi; (6) can be used to store gases, liquids or powder; (7) is formed (in a non-adsorbed natural gas embodiment) using water-soluble tooling; (8) can be non-spherical or non-cylindrical in shape (in addition to being spherical- or cylindrical-shaped; and (9) is easier to manufacture, more cost effective and more environmentally friendly than lined tanks.

An adsorbed natural gas ("ANG") pressure vessel made according to this invention is a formed by an all-composite shell formed around a rigid porous structure that serves as a mandrel when forming the shell and as a sorbent when the vessel is in use. The rigid porous structure may be any suitable, moldable or formable sorbent or structure for adsorbing natural gas, preferably an activated carbon or its equivalent.

In its final form, the composite shell and rigid porous structure comprise a single monolithic, liner-less structure. In one embodiment, the vessel is able to withstand internal pressures in range of 500 to 1,500 psi. In other embodiments, the vessel is able to withstand internal pressures in a range of 100 to 500 psi or 1,500 to 3,600 psi or more.

Other objectives of this invention include providing an ANG pressure vessel or tank that: (1) is all-composite material and metal-free; (2) uses the sorbent material as the mandrel when forming the vessel; (3) improves the volumetric and gravimetric efficiencies relative to existing adsorbed natural gas tanks; (4) reduces the effective pressure needed to store a volume of gas; (5) is conformable shaped (cylindrical or non-cylindrical); (6) avoids the use of a separate, rigid liner; (7) incorporates impermeability layers or strata into the composite structure; (8) can be used for pressure vessels in gas storage applications in a range of about 100 psi and up; and (9) can be used for cryogenic storage applications.

Non-cylindrical shaped vessels can also be made using a non-cylindrical shaped mandrel.

Figure 2:
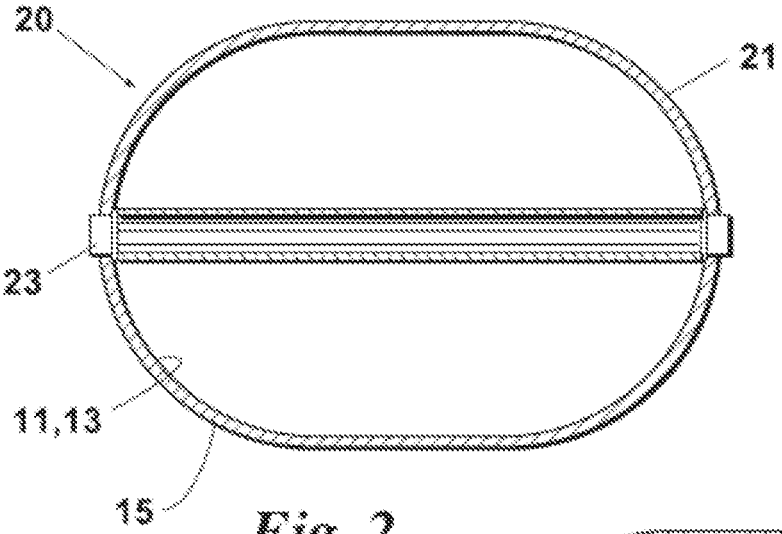
FIG. 2 is a cross-section view of a preferred embodiment of pressure vessel or tank using the composite material of FIG. 1 and having been formed about removable tooling.
Figure 3:
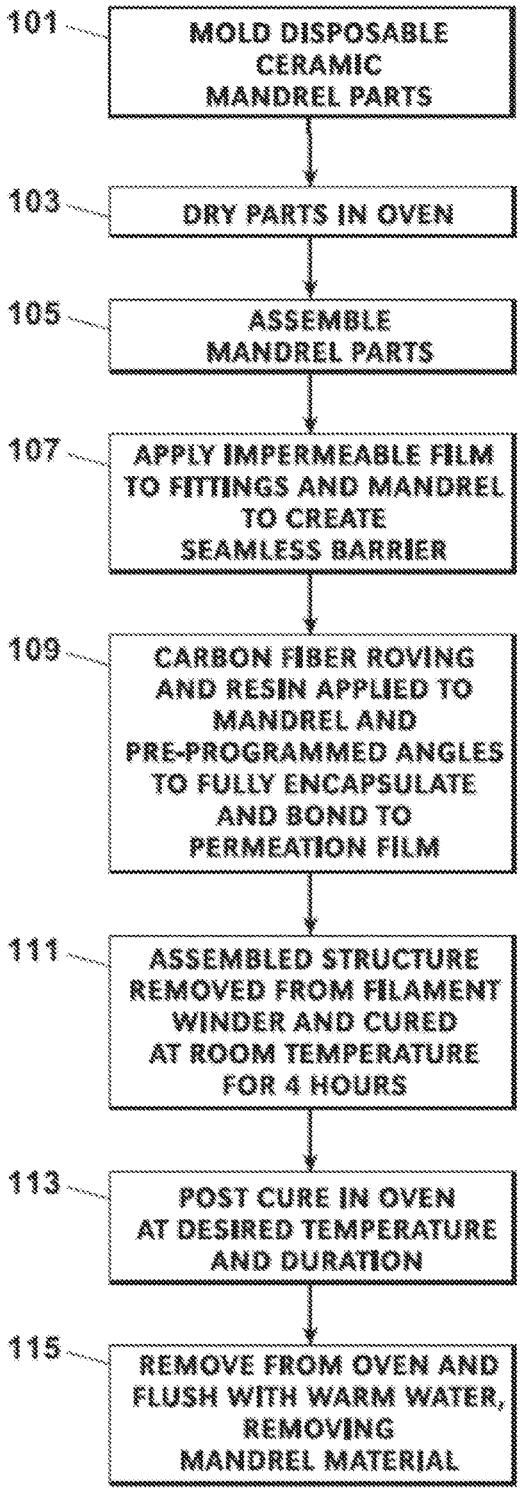
FIG. 3 is a process flow diagram of a method of manufacturing the vessel of FIG. 2.
Figure 4:
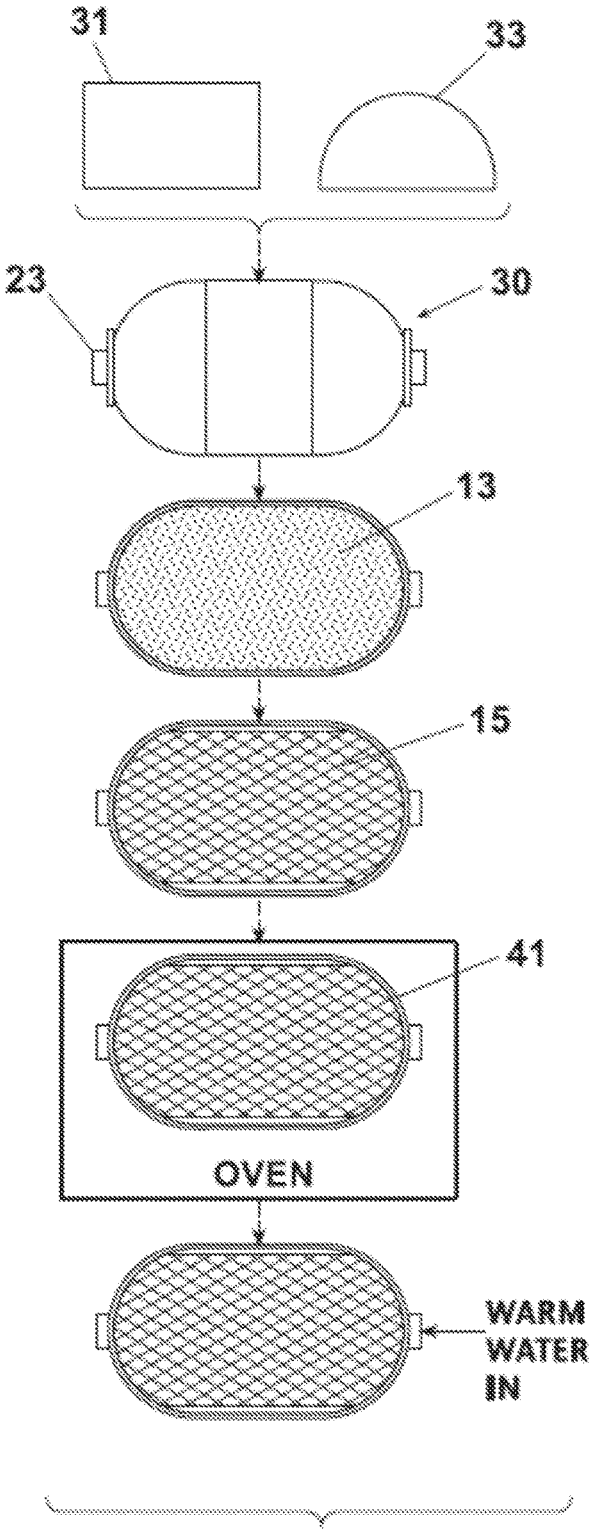

FIG. 4 is a schematic of the vessel of FIG. 2 as it is being manufactured using the process of FIG. 3.

Figure 1:
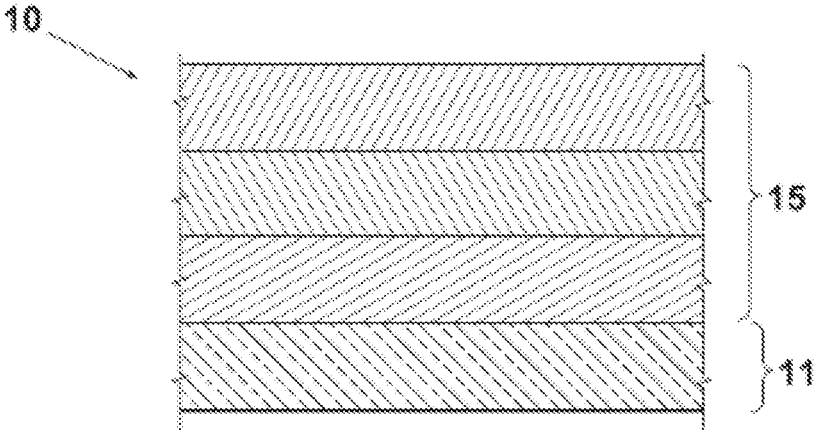
FIG. 1 is an enlarged cross-section view of a composite material made according to this invention and used to form the vessel shell. An impermeable film forms the most innermost layer to make a permeation barrier that eliminates the use of a liner. The composite shell of the vessel is formed using removable tooling (see FIGS. 3 and 4). The shell of the adsorbed natural gas ("ANG") vessel is formed using a rigid porous structure as the mandrel, which forms a monolithic structure with the shell and serves as a sorbent (see FIGS. 6 and 7).
Figure 5:
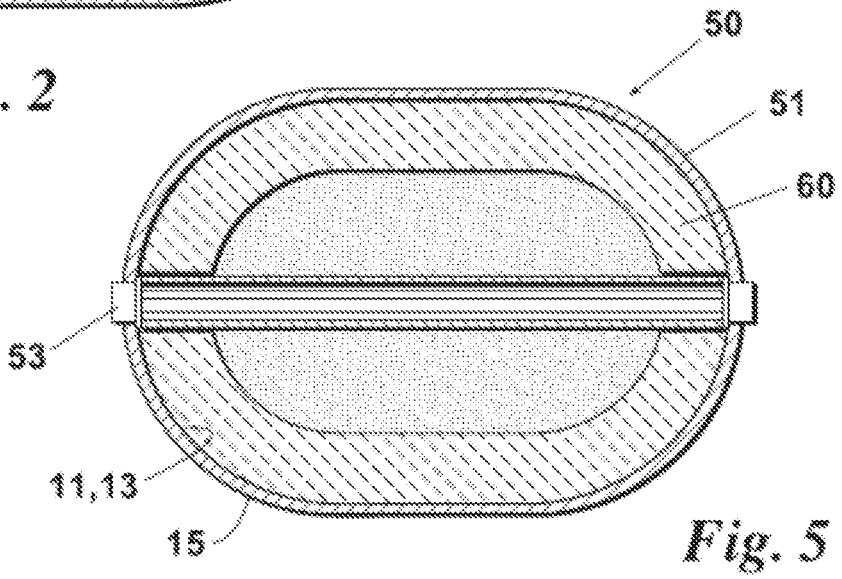

FIG. 5 is a cross-section view of a preferred embodiment of an ANG pressure vessel or tank made according to this invention and using the composite material of FIG. 1.

Figure 6:
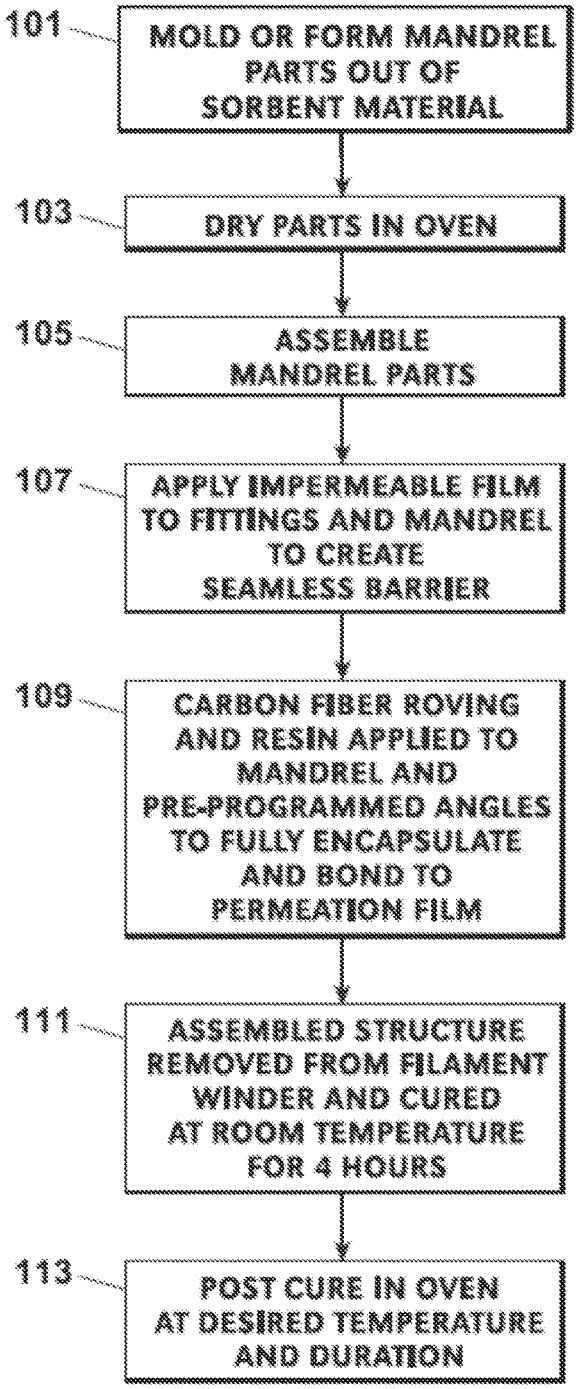

FIG. 6 is a process flow diagram of a method of manufacturing the vessel of FIG. 5. Non-cylindrical shaped vessels can also be made using a non-cylindrical shaped mandrel made of the sorbent material.

Figure 7:
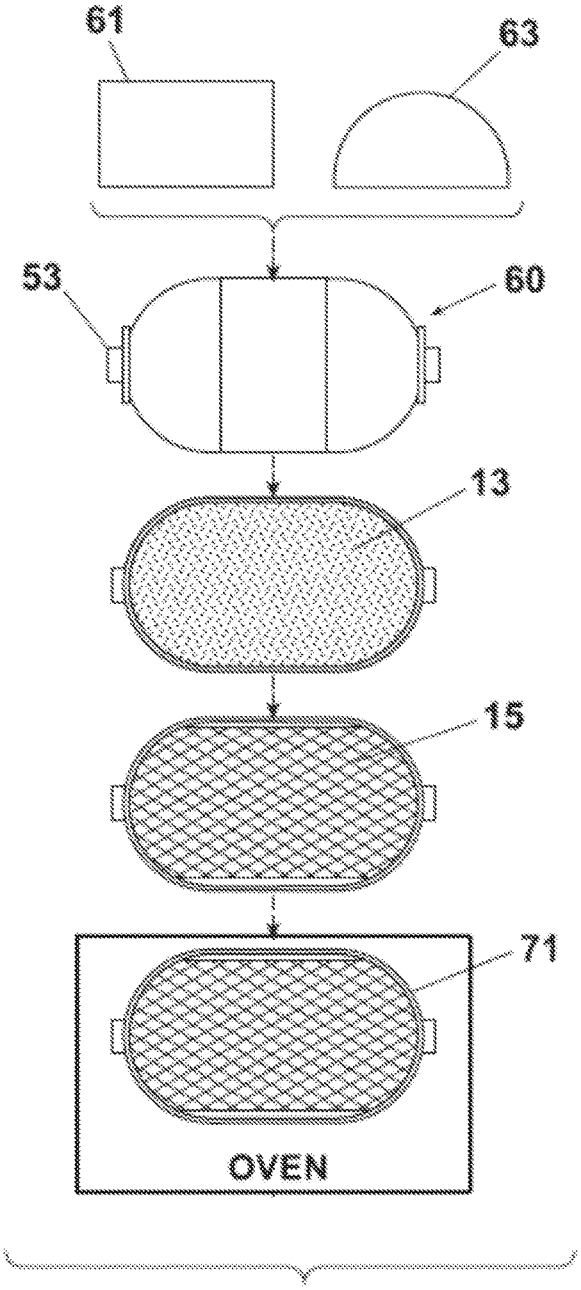

FIG. 7 is a schematic of the vessel of FIG. 5 as it is being manufactured using the process of FIG. 6.

Figure 8:
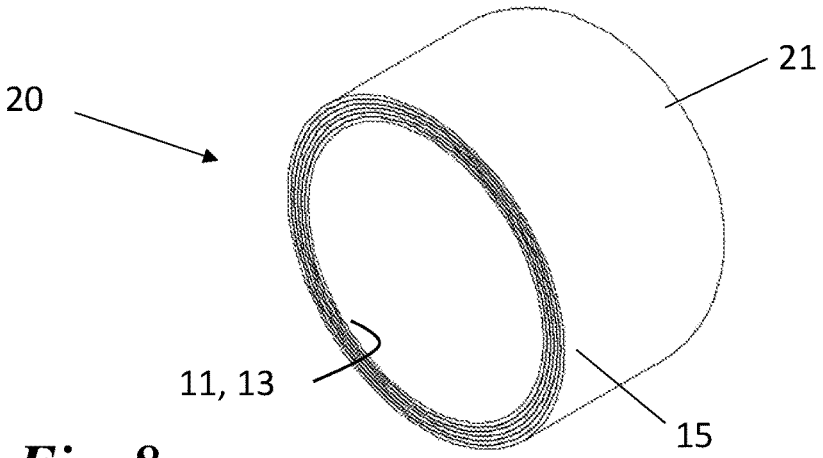

FIG. 8 is an isometric view of a preferred embodiment of the vessel main body made with removable tooling.

Figure 9:
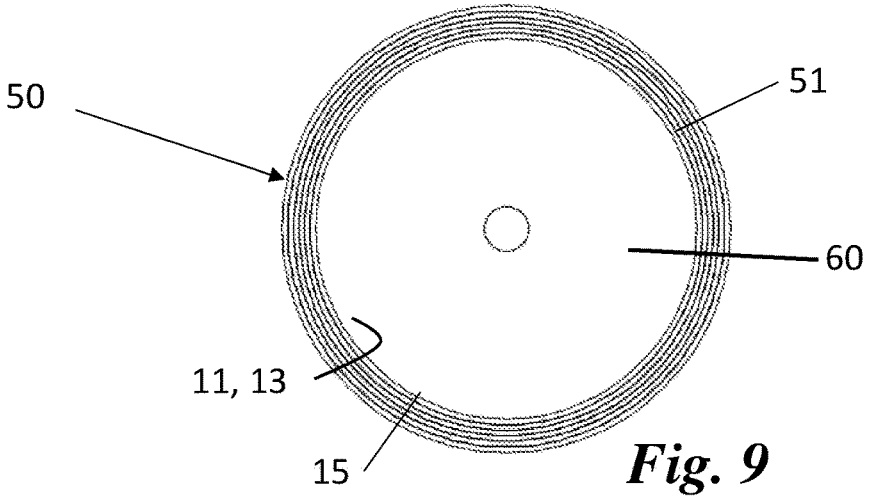

FIG. 9 is an isometric view of a preferred embodiment of the vessel main body made with permanent tooling, the tooling serving as a sorbent for the vessel.

Figure 10:
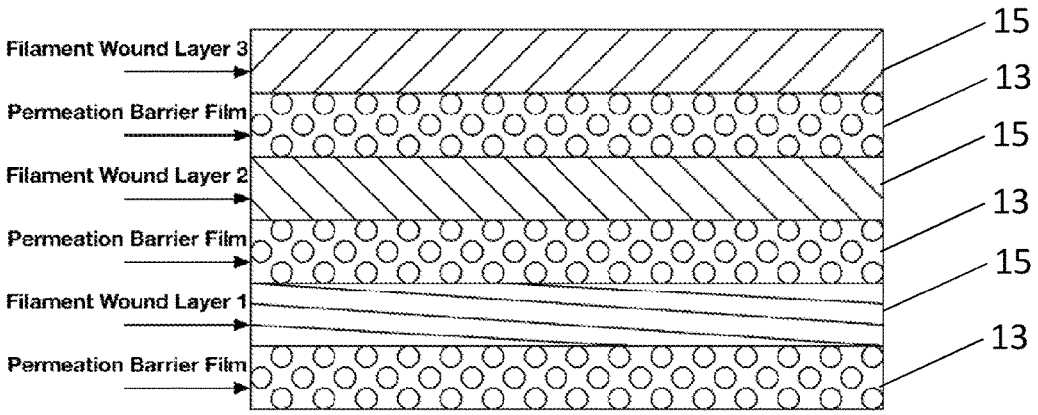

FIG. 10 is an enlarged cross-section view of an alternate embodiment of a composite material made according to this invention and used to form the vessel shell. An impermeable film forms the most innermost layer to make a permeation barrier that eliminates the use of a liner. A second (next outermost) layer is comprised of a carbon fiber roving and resin or its equivalent. The next layer is formed by the impermeable film which, in turn, is covered by another layer of carbon fiber and roving.

ELEMENTS AND NUMBERING USED IN THE DRAWINGS

10 Composite material of vessel shell
11 First or innermost layer or layers
13 Impermeable film
15 Second or next outermost layer or layers
20 Liner-less, all-composite pressure vessel formed from removable tooling
21 Shell
23 Fitting or fittings
30 Disposable mandrel
31 Main body
33 End or ends
41 Assembled vessel structure (shell, fitting, and mandrel combination)
50 Liner-less, all-composite ANG pressure vessel
51 Shell
53 Fitting or fittings
60 Sorbent mandrel
61 Main body or core
63 End or ends
101 Molding step
103 Molding step
105 Mandrel assembly step
107 First layer application step
109 Second layer application step
111 Curing step
113 Post curing step
115 Mandrel removing step

DETAILED DESCRIPTION OF THE INVENTION

A composite vessel made according to this invention is especially well-suited for use in high-pressure storage of gaseous matter such industrial and fuel gasses in compressed natural gas applications and compressed hydrogen fuel applications. A composite material made according to this invention also can be used in vessels to store other types of gasses, liquids and powders under pressure (or not under pressure) and can be used in one of its embodiments for adsorbed natural gas ("ANG") applications.

The pressure vessel includes a carbon fiber reinforced plastic with an integrated permeation barrier as its innermost layer. Alternating layers of permeation barrier and carbon fiber reinforced plastic may also be used for the vessel's shell. During manufacturing, the permeation barrier is sprayed on and integrated into (entrained in or drawn into) the composite. The vessel, which is well suited for high pressure gas storage is lighter weight than prior art vessels and has more usable volume than same-dimensioned prior art vessel. The permeation barrier encapsulates one or more ports or fittings of the vessel to reduce or eliminate the potential for gaps through which gas can escape. In one embodiment, a removable tooling process is employed in the manufacture of the vessel. In another embodiment, a permanent tooling process is employed and the tooling serves as a sorbent material for the vessel.

First Preferred Embodiment—Non-ANG Pressure Vessel (Removable Tooling)

Referring to FIGS. 1, 4, 8 and 9, the composite material 10 of the vessels 20, 50 includes a first (innermost layer or layers) 11 comprised of an impermeable film 13 such as, but not limited to, a thin polymer material film. There can be more than one layer 11 of impermeable film 13 and, in a preferred embodiment, up to three layers 11 of film 13. The vessels 20, 50 also include a second (next outermost) layer or layers 15 comprised of carbon fiber roving and resin. Nano-additives may be added to the resin matrix used in one or more of the layers 15 (see e.g., Seshasai Gandikota, Selective toughening of carbon/epoxy composites using graphene oxide. Master's Thesis, Oklahoma State University (December 2011), hereby incorporated by reference).

Alternatively, composite material 10 can include alternating layers of the impermeable film layer 13 and carbon fiber roving and resin layer 15 (see FIG. 10). The impermeable film 13 forms the most innermost layer 11 to make a permeation barrier that eliminates the use of a liner. A second (next outermost) layer 15 is comprised of a carbon fiber roving and resin or its equivalent. The next layer is formed by the impermeable film which, in turn, is covered by another layer of carbon fiber and roving. Preferably, there are three pairs of film and composite material layers 13, 15.

Referring to FIGS. 2 and 3, the process of making the vessel 20 out of material 10 includes the steps 101, 103 of molding disposable ceramic mandrel components—core 31 and ends 33—and drying the components 31, 33. The mandrel components 31, 33 also could be formed by machining rather than molding and may be any shape preferable such as but not limited to a flatter, non-cylindrical shaped mandrel 30. The dried mandrel components 31, 33 are then assembled together in an assembly step 105 to form the mandrel 30. The mandrel components 31, 33 may be any shape preferable such as but not limited to a flatter, non-cylindrical shaped mandrel 30.

A first application step 107 applies one or more layers 11 of impermeable film 13 to the fittings 23 and mandrel 30 to create a seamless barrier. Preferably, the film 13 is applied manually or by spraying. A second application step 109 makes use of a filament winder (not shown) and applies one or more layers 15 of carbon fiber roving and resin at preprogrammed angles to fully encapsulate, and bond to, the layer or layers 11 of impermeable film 13. Preferably, each layer 15 is applied at a different preprogrammed angle than its adjacent layer 15 or 11 (see e.g. FIG. 1). For example, one layer 15 can be at a first angle, another layer 15 at a second different angle from the first, and still another layer 15 at a third different angle from the first and second angles.

The assembled structure 41 consisting of the shell 21, fittings 23, and mandrel 30 is removed from the filament winder and cured, preferably at room temperature for about 4 hours, during a curing step 111. A post-curing step 113 then takes place in an oven at a desired temperature and duration.

A mandrel removing step 115 is accomplished by removing the post-cured material 37 from the oven and flushing the mandrel 30 with warm water, thereby removing the mandrel.

Second Preferred Embodiment—ANG Pressure Vessel (Permanent Tooling)

Referring to FIGS. 5 and 6, the process of making an ANG pressure vessel 50 out of material 10 includes the steps 101, 103 of molding or forming a rigid porous structure—such as an activated carbon or its equivalent—into mandrel core and ends 61, 63 and drying the components 61, 63. The mandrel components 31, 33 also could be formed by machining rather than molding and may be any shape preferable such as but not limited to a flatter, non-cylindrical shaped mandrel 60. The dried mandrel components 61, 63 are then assembled together in an assembly step 105 to form the mandrel 60.

A first application step 107 applies an impermeable film 11 to the fittings 53 and mandrel 60 to create a seamless barrier. Preferably, the film 13 is applied manually. A second application step 109 makes use of a filament winder (not shown) and applies carbon fiber roving and resin layer 15 at preprogrammed angles to fully encapsulate, and bond to, the layer or layers 11 of impermeable film 13. Each layer 15 is preferably at a different preprogrammed angle than its adjacent layer 15 or 11 (see e.g. FIG. 1). Similar to the first embodiment, one layer 15 can be at a first angle, another layer 15 at a second different angle from the first, and still another layer 15 at a third different angle from the first and second angles.

The assembled structure 71 consisting of shell 51, fittings 51, and sorbent mandrel 60 is removed from the filament winder and cured, preferably at room temperature for about 4 hours, during a curing step 111. A post-curing step 113 then takes place in an oven at a desired temperature and duration.

The mandrel 60 remains a part of the vessel 50.

Preferred embodiments of the pressure vessel have been described so as to enable of person of ordinary skill in the art to make and use the invention, which is defined by the claims listed below. The claims cover designs that substitute one or more of the elements listed with equivalent elements.

What is claimed:

1. A liner-free pressure vessel comprising:
- a mandrel including a sorbent material;
- a composite shell formed about and surrounding the mandrel;
- the composite shell including:
  - an innermost layer of impermeable film located immediately adjacent to the mandrel and surrounded by a layer of composite material; and
  - a second layer of impermeable film surrounding the layer of composite material and being surrounded by a second layer of the composite material;
  - a third layer of impermeable film surrounding the second layer of composite material and being surrounded by a third layer of the composite material;
- the impermeable film layers being integrated into the composite material layers during curing of the pressure vessel;
  - wherein the composite shell and the mandrel comprise a monolithic structure, the mandrel being a permanent component of the pressure vessel; and
- wherein the pressure vessel does not include a plastic or metallic liner; and
- wherein when in an intended use of the pressure vessel the mandrel is adapted to adsorb natural gas.

2. A liner-free pressure vessel according to claim 1 wherein the impermeable film is a non-metallic material.

3. A liner-free pressure vessel according to claim 1 wherein the impermeable film includes metallic additives.

4. A liner-free pressure vessel according to claim 1 wherein the impermeable film is a polymer material.

5. A liner-free pressure vessel according to claim 1 wherein the composite material includes a carbon fiber roving and resin matrix.

6. A liner-free pressure vessel according to claim 1 further wherein a filament winding of said second layer of composite material is oriented at a different angle than a filament winding of said third layer of composite material.

7. A liner-free pressure vessel according to claim 1 wherein the pressure vessel is cylindrical shaped.

8. A liner-free pressure vessel according to claim 1 wherein the pressure vessel is non-cylindrical shaped.

9. A liner-free pressure vessel according to claim 1 wherein the pressure vessel is pressure-rated up to 10,000 psi.

10. A liner-free pressure vessel according to claim 1 wherein the pressure vessel has a useable storage volume in a range of 1 gallon to 10,000 gallons of its total volume.

* * * * *